United States Patent [19]

Durston

[11] Patent Number: 4,897,971

[45] Date of Patent: Feb. 6, 1990

[54] WASHROOM PARTITION

[75] Inventor: Gordon G. Durston, Belmont, Canada

[73] Assignee: GSW Inc., Toronto, Canada

[21] Appl. No.: 261,313

[22] Filed: Oct. 24, 1988

[51] Int. Cl.[4] ..... E04C 2/40

[52] U.S. Cl. ..... 52/35; 52/238.1; 52/404; 52/802; 52/806; 428/73; 428/116; 428/118

[58] Field of Search ..... 52/35, 238.1, 239, 241, 52/404, 406, 407, 785, 802–810, 811, 813, 403; 428/73, 116, 118

[56] References Cited

U.S. PATENT DOCUMENTS

| | | | |
|---|---|---|---|
| 3,267,626 | 8/1966 | Daly | 52/805 X |
| 3,336,713 | 8/1967 | Privas | 52/403 |
| 3,450,593 | 6/1969 | Fossier et al. | 52/806 X |
| 3,786,613 | 1/1974 | Shepheard | 52/802 |

*Primary Examiner*—Richard E. Chilcot, Jr.

[57] ABSTRACT

The present invention relates to fabricated metal toilet stall panels comprising opposed panel sheets, each having flanged edges which cooperate to define an essentially hollow core. The panels at the flanged edges include an inwardly directed sealing flange in abutting opposed relation with the like sealing flange of the opposed panel sheet. The metal panels are at least primarily secured to each other by an adhesive seal between the sealing flanges. The method of the present application comprises forming of the metal panels, including the flanged edges with the inwardly directed sealing flange, placing opposed panels in abutting contact such that the sealing flanges generally engage, applying an adhesive between the sealing flanges, and maintaining the particular relationship of the panel sheets until the adhesive has cured to an extend sufficient to maintain the engagement of the panels.

14 Claims, 4 Drawing Sheets

WASHROOM PARTITION

FIELD OF THE INVENTION

The present invention relates to fabricated metal toilet stalls, in particular the fabricated members used in assembling of the toilet stalls. The invention also relates to a new method for forming such fabricated members or panels.

BACKGROUND OF THE INVENTION

Toilet stalls and the various panels used in the assembly thereof, including pilasters, headrails, doors, and privacy panels, are well known and subject to substantial abuse. It can also be appreciated that this product is price sensitive and therefore the development has necessitated a design which results in a durable, relatively low cost product. In order to satisfy this requirement, the prior art has traditionally used metal panels having a hollow core with a reinforcing network secured within the hollow core. This results in the panels being formed from sheet type material which is shaped during a forming operation and which cooperates with a like panel to effect securement. The most popular arrangement for securing panels uses the panel sheets of slightly different sizes and relies on a spring type engagement, with one panel fitting within the other for securement thereof. This spring type engagement of one panel to the other has worked satisfactorily and obviously uses the durable surface of the sheet material in combination with the reinforcing material to stiffen the panel and reduce damage caused by kicking or other forms of vandalism. This spring type engagement does cause problems, in that the panels sheets have to be paired, one relative to the other, and they are of two separate distinct sizes. This obviously duplicates tooling and storage and complicates assembly of the structure.

Other arrangements for securing one panel of the other have been used in the past, such as using identical panels having inwardly directed flanges in abutting contact and using a tack welding technique at the corners and at spaced points along the length of the seam to positively secure one panel to the other. This leaves substantial gaps which are not held in securement and also results in a complicated process as the welds often require filing to provide a satisfactory finish.

There remains a need to provide a satisfactory product which is easier to manufacture.

SUMMARY OF THE INVENTION

According to the present invention, a fabricated metal toilet stall panel comprises opposed panel sheets, each having flanged edges which cooperate to define an essentially hollow core. The panels at the flanged edges include an inwardly directed sealing flange in abutting opposed relationship with the like sealing flange of the opposed panel sheet. The metal panels are at least primarily secured to each other by a suitable adhesive seal between the sealing flanges. Such a fabricated toilet stall panel greatly simplifies the manufacture of the same and allows the use of an identical panel sheet for forming of the finished product. The adhesive securement can be applied by a robot and the panels held in opposed relationship until the adhesive has cured sufficiently to maintain engagement of the panel sheets. In addition, a reinforcing network can be applied interior to the panel which is also held to each panel by means of an adhesive. Thus, the curing of the seal between the sealing flanges and the adhesive of the reinforcing member can occur simultaneously.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
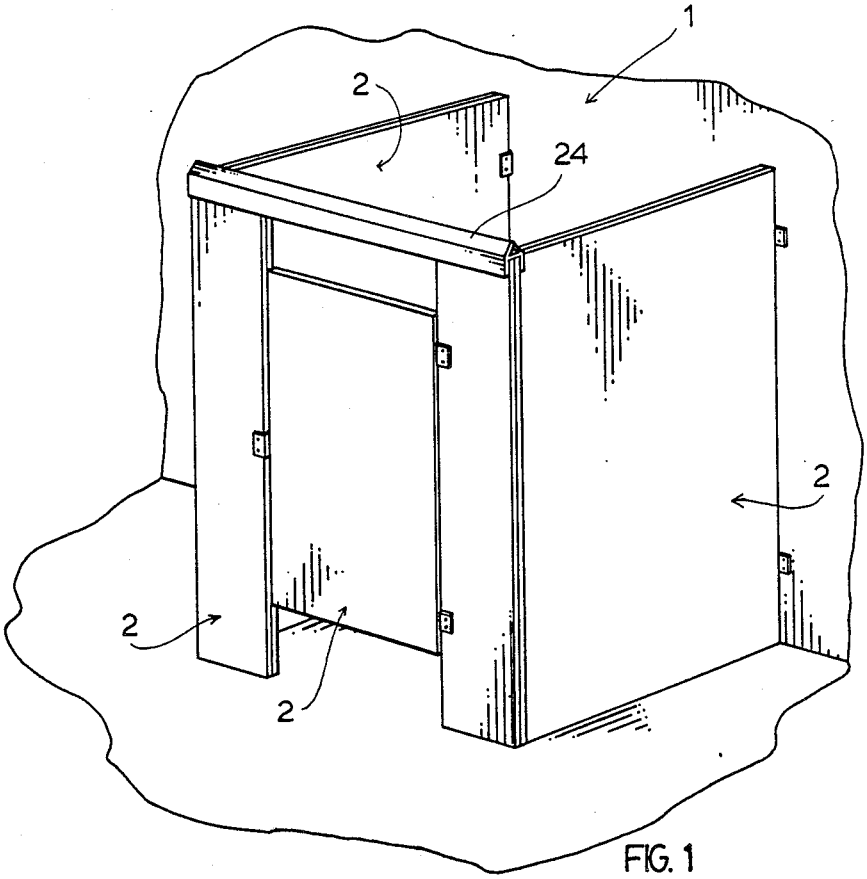
FIG. 1 is a general view of a toilet stall system.
Figure 2:
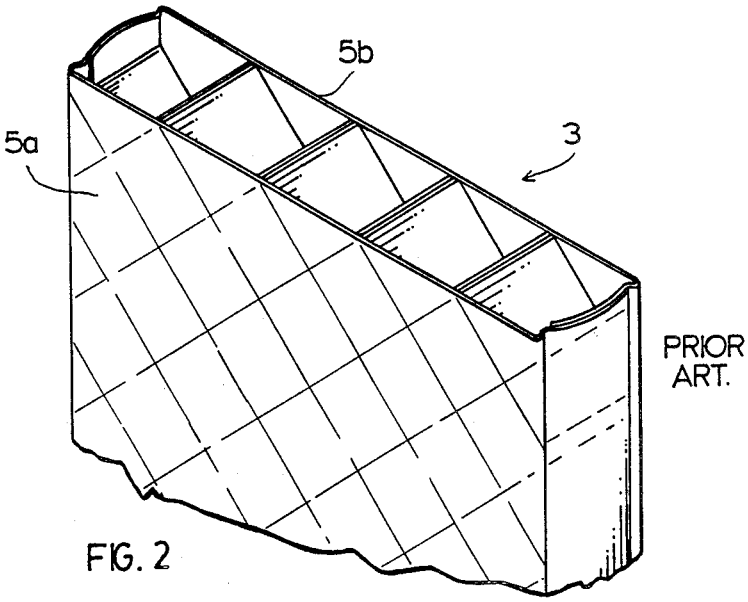
FIG. 2 is a partial sectional view of a prior art structure.

The toilet stall 1 shown in FIG. 1 includes fabricated metal panels 2 in the form of privacy panels, doors and pilasters. All of these components are essentially of rectilinear shape. The typical sectional view of a prior art panel is shown in FIG. 2, where opposed panel sheets 5*a* and 5*b* have a snap-lock type connection with one of the panels being slightly smaller than the other. As discussed in the background, such an arrangement results in problems with respect to the forming of the panels and the necessity for separate manufacture and storage of the panels, as well as pairing of the panels in forming the final product.

Figure 3:
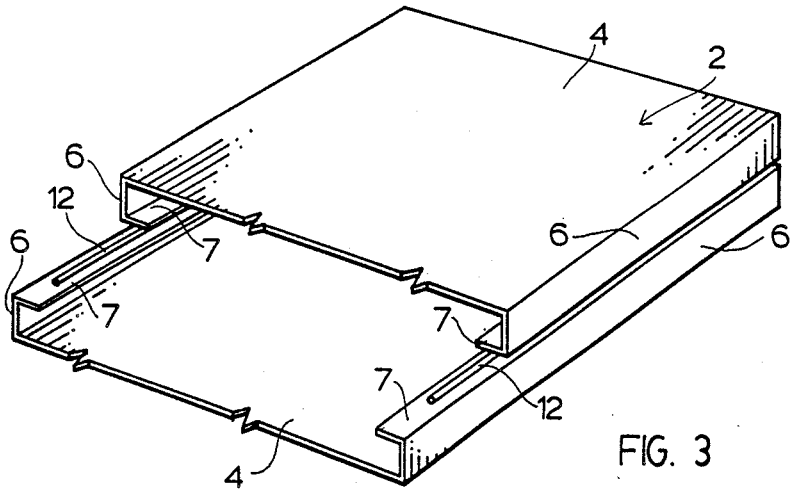
FIG. 3 illustrates two panel sheets secured by an adhesive bead with the honeycomb or reinforcing member omitted for clarity.
Figure 4:
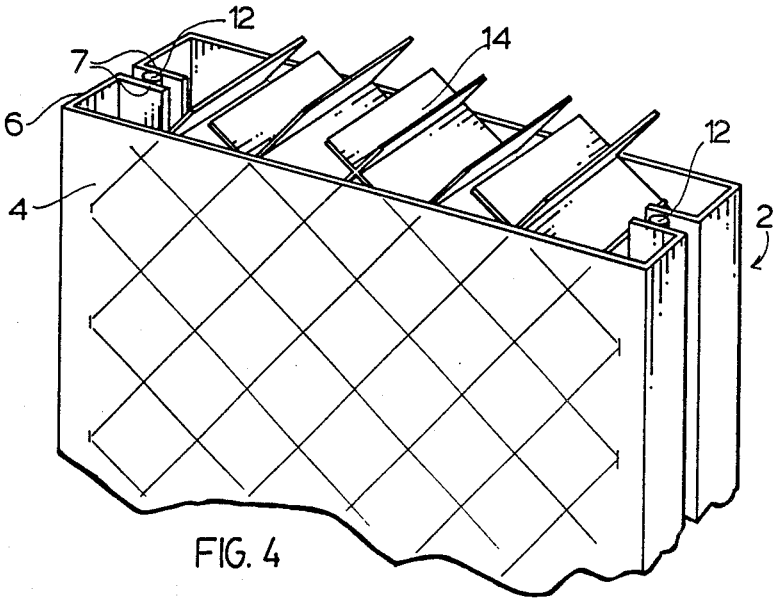
FIG. 4 is a partial perspective view showing securement of the panel sheets and the honeycomb reinforcing member.
Figure 5:
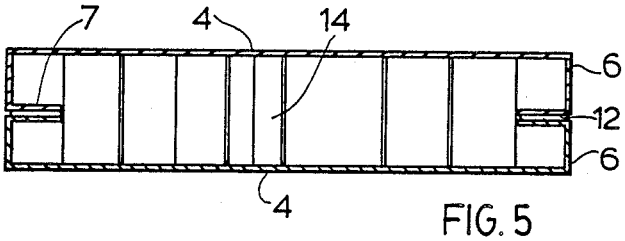
FIG. 5 is a typical sectional view after the panels have been pressed together.

FIGS. 3 through 5 illustrate the fabricated metal panel used in the toilet stall system 1. Each fabricated metal panel 2 includes opposed panel sheets 4 having flanged edges 6, in this case, 'L' shaped flanges which define an inwardly directed sealing flange 7. The panel sheets 4 are held in securement by means of an adhesive bead or continuous seal 12 which is intermediate the opposed sealing flanges 7. This adhesive forms the primary means of securing the panels and in the preferred embodiment, forms the exclusive means of securing one panel sheet to the other. A number of high strength adhesives are now available which provide a strong adhesive bond between metal parts. Such adhesives have gained some acceptance in the aeronautical industry for joining metal components.

In FIG. 3, the reinforcing network of lightweight material 14 shown in FIG. 4 has been omitted. This reinforcing material is preferred to effectively transfer forces exerted on one panel sheet 4 to the other and thereby integrate and distribute the forces exerted on the fabricated metal panel. This reinforcing network is adhesively secured to the interior of the panel sheets and the adhesive, as well as the adhesive seal 12, requires curing after it has been applied. In order to accomplish this, the panels are maintained in their abutting opposed relationship as generally shown in FIG. 5 until the adhesives have sufficiently cured to effect securement of both the lightweight reinforcing material and the sealing flanges 7.

Figure 6:
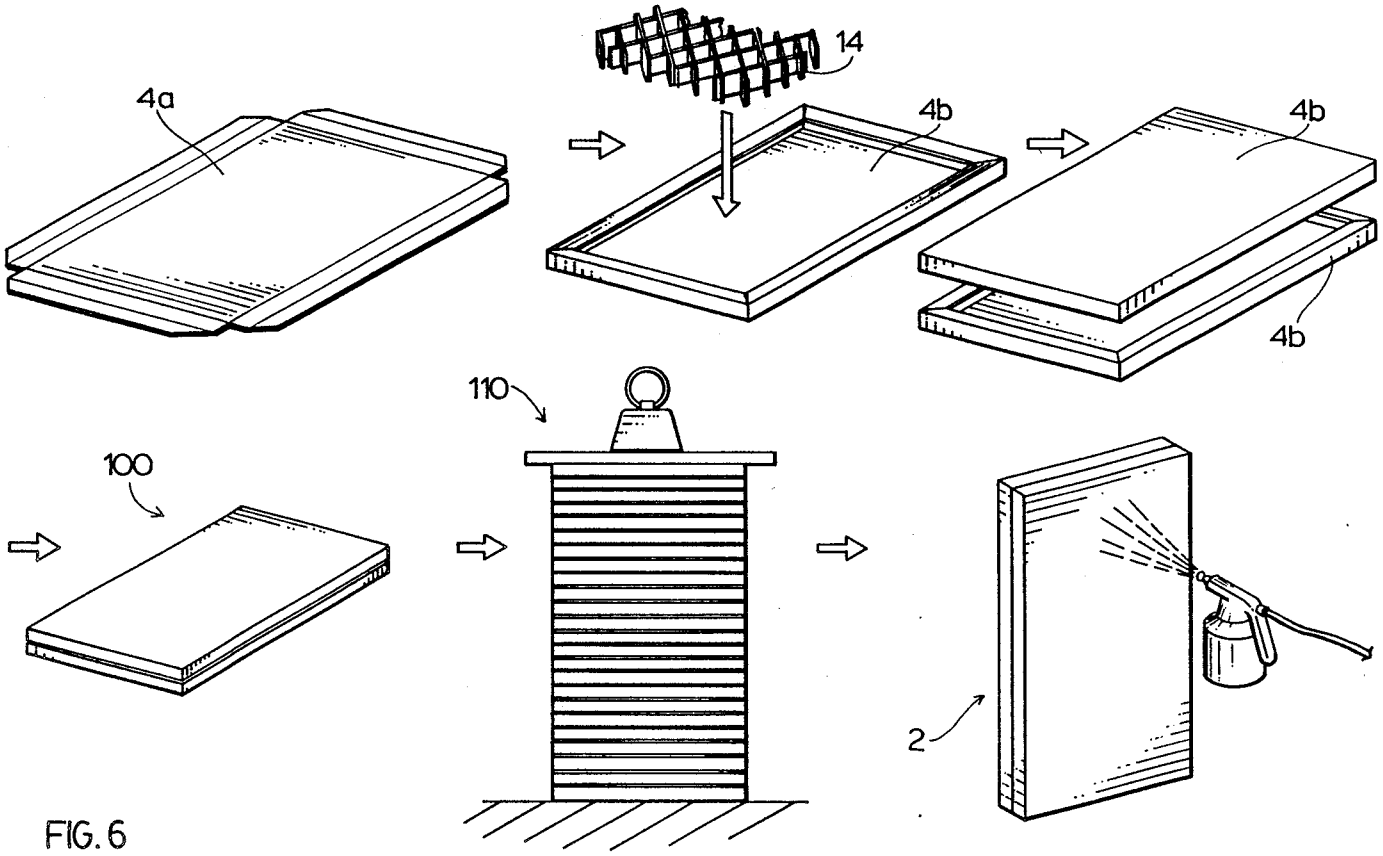
FIG. 6 illustrates the process of the present invention.

The method of manufacture of the fabricated metal panel is generally shown in FIG. 6 where a panel sheet 4*a* has been notched from sheared to size steel sheets normally supplied by the steel supplier. The sheets are subsequently processed to form the flanged edges illustrated by the panel sheet 4*b*. The reinforcing material 14 is placed in the panel sheet 4*b* with adhesive applied to both surfaces of the reinforcing network. Two panel sheets are then brought into opposed contact relationship, with one of the panel sheets having the reinforcing network 14 with the upper side of this network having an adhesive to effect securement with the opposite panel sheet. The panels are shown in abutting contact relationship indicated by numeral 100. Several of these panels are stored with a weight applied thereto as shown at 110. After the adhesive has sufficiently cured that the structural integrity of the panel is assured, the panels are then painted and further processed in preparation for use in a toilet stall system.

Figure 8:
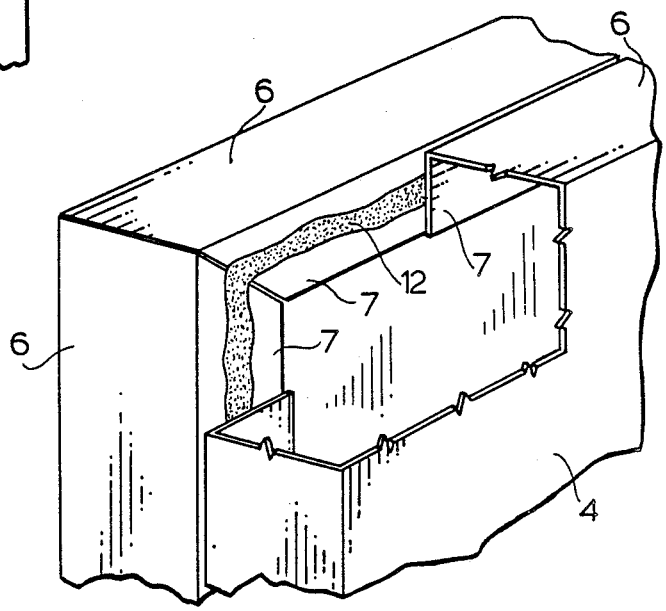
FIG. 8 is a sectional view of a corner of two panel sheets.

Details of the corner securement of the panels is shown in FIG. 8 where the flanged panel edges merge at a 45° junction and an adhesive seal is applied across this junction. Thus, the adhesive bead 12 can be continuous and effect a continuous seal across the entire sealing flanges and about the periphery thereof. This reduces the possibility of leakage into the panel, as the only regions which are not sealed will be the corners of the panel. If necessary, an adhesive can be applied to these interior edges to effectively seal the same.

Figure 7:
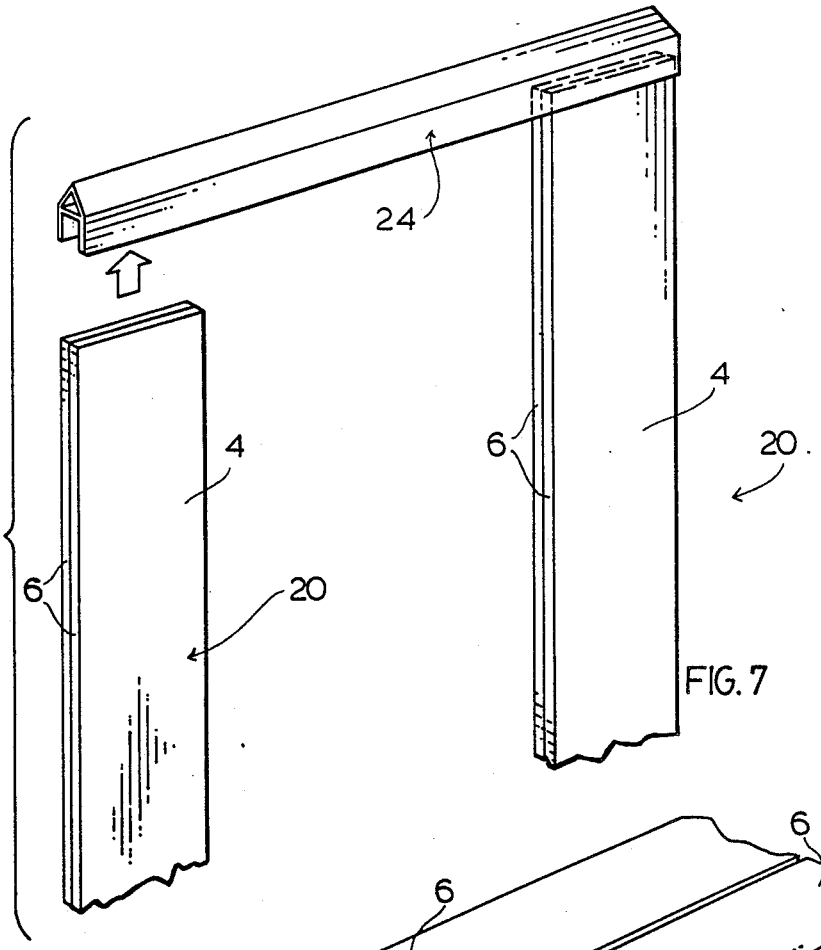
FIG. 7 is a partial perspective view showing securement of a pilaster to a headrail.

The method of securing the pilaster to headrail 24 is generally shown in FIG. 7 and it can be appreciated that the headrail 24 is applied over the top edges of the pilasters 20 and is held in place by screws. This headrail has a sloped top portion to allow water to run off thereof. Thus, each pilaster is sealed and the headrail will further protect the upper edge of the pilaster during washing or the like. The headrail serves as a mechanical connector providing structural support joining the pilasters.

The present design is particularly suitable for automated manufacture and does not require pairing of individual panels. It merely requires panels to be placed in opposed relationship and, thus, the panels eventually secured in opposed relationship should have similar tolerances as they have been made from the same run of sheet material and the quality of the steel will be essentially identical. This results in much better uniformity and reduces the possibility of error in the manufacturing of the product. The panel is also totally sealed between the sealing flanges and the only area where water or other material could enter is at the corner regions. Again, these can be sealed if desired. The overall product is of a rectilinear shape and the inwardly directed sealing flanges not only provide an effective sealing surface, but also result in a strong periphery of the fabricated panels. With these flanges being secured one to the other about their entire length, the strength of the end product is also increased. Thus, it is possible to significantly increase the strength of the fabricated panel and in separate torque tests used for products of this type, the above design has proven to be two to three times stronger than the prior art structure shown in FIG. 2.

With respect to sealing of the panels, it can be appreciated that in a hospital environment or even a school environment it is often necessary to clean the toilet stall quite extensively, resulting in a substantial amount of water being applied to the toilet stall. The fact that a large portion of the fabricated panels have been sealed reduces the possibility of the water or cleansing fluid deteriorating the interior of the panel, as no side leakage between the sealing flanges will occur. Other benefits such as a reduced area for bacteria to collect and grow are also apparent from the design.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A fabricated metal toilet stall panel comprising opposed metal panel sheets, each panel sheet has a flat face bordered by flanged edges which cooperate to define an essentially hollow core, said panels at said flanged edges including an inwardly directed sealing flange generally parallel to the respective flat face and in abutting opposed relation with the like sealing flange of the opposed panel sheet, said metal panels being secured to each other by an adhesive seal between said sealing flanges.

2. A fabricated metal panel as claimed in claim 1, wherein said adhesive seal forms at least an essentially continuous seal adjacent the perimeter of said sealing flanges to effectively seal said hollow core.

3. A fabricated metal panel as claimed in claim 2, wherein said hollow core includes a reinforcing network of a lightweight material.

4. A fabricated metal panel as claimed in claim 3, wherein said lightweight material is cardboard.

5. A fabricated metal panel as claimed in claim 2, wherein each panel is of the same shape.

6. A fabricated metal panel as claimed in claim 5, wherein each panel sheet has a flat face bordered by an 'L' shaped edge portion defining said flanged edge and sealing flange.

7. In a fabricated toilet stall system, a fabricated member comprising two opposed metal panels, each panel including a flat face bordered by a flange portion partially defining the edge of said member and including an inwardly directed sealing flange parallel to the respective flat face and in abutting contact with the sealing flange of the opposed panel, said opposed panels being held in securement at least primarily by an adhesive seal intermediate said abutting sealing flanges.

8. In a fabricated toilet stall system as claimed in claim 7, wherein said adhesive at least essentially provides a continuous seal between said sealing flanges adjacent the periphery of the fabricated member.

9. In a fabricated toilet stall system as claimed in claim 8, wherein said fabricated member is essentially rectilinear.

10. In a fabricated toilet stall system as claimed in clim 9, wherein said opposed panels are identical.

11. In a fabricated toilet stall system as claimed in claim 10, wherein said fabricated member is a privacy panel, door, or pilaster.

12. In a fabricated toilet stall system as claimed in claim 10, having a number of privacy panels, a door, and a pilaster, each of which is formed as a fabricated member.

13. A method of manufacturing a fabricated member for use in a toilet stall system, said method comprising notching sheared to size panel sheets, forming flanged panel sheets from said notched panel sheets suitable for placing in opposed contact due to abutting flange contact to form a fabricated member, bring flanged panel sheets into opposed contact due to abutting flanges, applying a suitable adhesive to said panels intermediate said flanged contact, applying pressure to said fabricated member in a manner to maintain abutting flange contact until sufficient strength of the adhesive has been established to maintain securement of said panels, and painting said fabricated members.

14. A method as claimed in claim 13, including securing a reinforcing member intermediate said flanged panel sheets which extends between flat opposed faces of said panel sheets when said panels are in abutting flange contact.

* * * * *